US008505634B2

(12) United States Patent
Lyons et al.

(10) Patent No.: US 8,505,634 B2
(45) Date of Patent: Aug. 13, 2013

(54) EARTH-BORING TOOLS HAVING DIFFERING CUTTING ELEMENTS ON A BLADE AND RELATED METHODS

(75) Inventors: Nicholas J. Lyons, Houston, TX (US); Danny E. Scott, Montgomery, TX (US); Rudolf Carl Pessier, Spring, TX (US); David Gavia, The Woodlands, TX (US); Juan Miguel Bilen, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 265 days.

(21) Appl. No.: 12/793,396

(22) Filed: Jun. 3, 2010

(65) Prior Publication Data

US 2011/0155472 A1 Jun. 30, 2011

Related U.S. Application Data

(60) Provisional application No. 61/290,401, filed on Dec. 28, 2009.

(51) Int. Cl.
*E21B 10/43* (2006.01)

(52) U.S. Cl.
USPC ..... 166/378; 175/430; 175/431

(58) Field of Classification Search
USPC ..... 175/430, 431, 432, 327, 57; 166/378
See application file for complete search history.

(56) References Cited

U.S. PATENT DOCUMENTS

| | | | |
|---|---|---|---|
| 3,459,073 | A | 8/1969 | Conover |
| 4,373,593 | A | 2/1983 | Phaal et al. |
| 4,440,247 | A | 4/1984 | Sartor |
| 4,471,845 | A | 9/1984 | Jurgens |
| 4,499,958 | A | 2/1985 | Radtke et al. |
| 4,602,691 | A | 7/1986 | Weaver |
| 4,718,505 | A | 1/1988 | Fuller |
| 4,722,405 | A | 2/1988 | Langford, Jr. |
| 4,823,892 | A | 4/1989 | Fuller |
| 4,869,330 | A | 9/1989 | Tibbitts |
| 4,889,017 | A | 12/1989 | Fuller et al. |
| 4,942,933 | A | 7/1990 | Barr et al. |
| 4,981,184 | A | 1/1991 | Knowlton et al. |
| 5,186,268 | A | 2/1993 | Clegg |
| 5,244,039 | A | 9/1993 | Newton |
| 5,303,785 | A | 4/1994 | Duke |

(Continued)

FOREIGN PATENT DOCUMENTS

| | | | |
|---|---|---|---|
| EP | 972908 | A2 | 1/2000 |
| GB | 2086451 | A | 5/1982 |

OTHER PUBLICATIONS

International Search Report for International Application No. PCT/US2011/023922 mailed Sep. 7, 2011, 3 pages.

(Continued)

*Primary Examiner* — Nicole Coy
(74) *Attorney, Agent, or Firm* — TraskBritt

(57) ABSTRACT

Earth-boring tools include combinations of shearing cutting elements and gouging cutting elements on a blade of the earth-boring tools. In some embodiments, a gouging cutting element may be disposed adjacent to a shearing cutting element on a blade of an earth-boring tool. Methods of forming earth-boring tools include providing such combination of at least one shearing cutting element and at least one gouging cutting element on a blade of an earth-boring tool.

24 Claims, 6 Drawing Sheets

(56) References Cited

U.S. PATENT DOCUMENTS

| | | | | |
|---|---|---|---|---|
| 5,487,436 | A | 1/1996 | Griffin | |
| 5,505,273 | A | 4/1996 | Azar | |
| 5,531,281 | A | 7/1996 | Murdock | |
| 5,549,171 | A | 8/1996 | Mensa et al. | |
| 5,558,170 | A | 9/1996 | Thigpen et al. | |
| 5,595,252 | A | 1/1997 | O'Hanlon | |
| 5,607,024 | A | 3/1997 | Keith | |
| 5,649,604 | A | 7/1997 | Fuller et al. | |
| 5,720,357 | A | 2/1998 | Fuller et al. | |
| 5,890,552 | A | 4/1999 | Scott et al. | |
| 5,904,213 | A | 5/1999 | Caraway et al. | |
| 5,957,227 | A | 9/1999 | Besson et al. | |
| 5,967,246 | A | 10/1999 | Caraway et al. | |
| 5,992,547 | A | 11/1999 | Caraway et al. | |
| 6,053,263 | A | 4/2000 | Meiners | |
| 6,059,054 | A | 5/2000 | Portwood et al. | |
| 6,089,336 | A | 7/2000 | Nexton et al. | |
| 6,092,613 | A | 7/2000 | Caraway et al. | |
| 6,129,161 | A | 10/2000 | Roberts et al. | |
| 6,142,250 | A | 11/2000 | Griffin et al. | |
| 6,209,420 | B1 | 4/2001 | Butcher et al. | |
| 6,328,117 | B1 * | 12/2001 | Berzas et al. | 175/57 |
| 6,332,503 | B1 | 12/2001 | Pessier et al. | |
| 6,401,844 | B1 | 6/2002 | Doster et al. | |
| 6,408,958 | B1 | 6/2002 | Isbell et al. | |
| 6,612,383 | B2 | 9/2003 | Desai et al. | |
| 6,615,934 | B2 | 9/2003 | Mensa-Wilmot | |
| 7,025,156 | B1 | 4/2006 | Caraway | |
| 7,216,565 | B2 | 5/2007 | Sherwood, Jr. et al. | |
| 7,546,888 | B2 | 6/2009 | Cruz | |
| 7,594,554 | B2 | 9/2009 | Schwefe et al. | |
| 7,628,233 | B1 | 12/2009 | Hall et al. | |
| 7,641,002 | B2 | 1/2010 | Hall et al. | |
| 2003/0034180 | A1 | 2/2003 | Mensa-Wilmot | |
| 2004/0149493 | A1 | 8/2004 | McDonough | |
| 2004/0184944 | A1 | 9/2004 | Geving et al. | |
| 2004/0231894 | A1 | 11/2004 | Dvorachek | |
| 2006/0131075 | A1 * | 6/2006 | Cruz | 175/57 |
| 2006/0249309 | A1 | 11/2006 | Cruz | |
| 2007/0039761 | A1 | 2/2007 | Cruz | |
| 2007/0106487 | A1 | 5/2007 | Gavia et al. | |
| 2007/0199739 | A1 | 8/2007 | Schwefe et al. | |
| 2007/0261890 | A1 | 11/2007 | Cisneros | |
| 2007/0272445 | A1 | 11/2007 | Cariveau et al. | |
| 2008/0035380 | A1 | 2/2008 | Hall et al. | |
| 2008/0035387 | A1 | 2/2008 | Hall et al. | |
| 2008/0173482 | A1 | 7/2008 | Hall et al. | |
| 2008/0179106 | A1 | 7/2008 | Gavia et al. | |
| 2008/0179107 | A1 | 7/2008 | Doster | |
| 2008/0179108 | A1 | 7/2008 | McClain et al. | |
| 2008/0264695 | A1 | 10/2008 | Zahradnik et al. | |
| 2008/0302575 | A1 | 12/2008 | Durairajan et al. | |
| 2008/0314647 | A1 | 12/2008 | Hall et al. | |
| 2009/0051211 | A1 | 2/2009 | Hall et al. | |
| 2009/0055135 | A1 | 2/2009 | Tang et al. | |
| 2009/0126998 | A1 | 5/2009 | Zahradnik et al. | |
| 2009/0133938 | A1 | 5/2009 | Hall et al. | |
| 2009/0145669 | A1 | 6/2009 | Durairajan et al. | |
| 2009/0266619 | A1 | 10/2009 | Durairajan et al. | |
| 2009/0273224 | A1 | 11/2009 | Hall | |
| 2010/0263939 | A1 | 10/2010 | Hall et al. | |
| 2010/0326740 | A1 | 12/2010 | Hall et al. | |
| 2011/0042150 | A1 | 2/2011 | Hall et al. | |
| 2011/0083906 | A1 | 4/2011 | Hall et al. | |
| 2011/0192651 | A1 | 8/2011 | Lyons et al. | |
| 2012/0023833 | A1 | 2/2012 | Hall et al. | |
| 2012/0031674 | A1 | 2/2012 | Lyons | |
| 2012/0125687 | A1 | 5/2012 | Rives | |

OTHER PUBLICATIONS

International Written Opinion for International Application No. PCT/US2011/023922 mailed Sep. 7, 2011, 3 pages.

Lyons et al., U.S. Appl. No. 13/022,288 entitled, Shaped Cutting Elements on Drill Bits and Other Earth-Boring Tools, and Methods of Forming Same, filed Feb. 7, 2011.

Gavia et al., U.S. Appl. No. 13/101,840 entitled, Earth-Boring Tools and Methods of Forming Such Earth-Boring Tools, filed May 5, 2011.

International Search Report for International Application No. PCT/US2010/060739 mailed Jun. 23, 2011, 3 pages.

International Written Opinion for International Application No. PCT/US2010/060739 mailed Jun. 23, 2011, 4 pages.

Bilen et al., U.S. Appl. No. 61/596,433 entitled, Shaped Cutting Elements for Earth-Boring Tools, Earth-Boring Tools Including Such Cutting Elements, and Related Methods, filed Feb. 8, 2012.

International Preliminary Report on Patentability for International Application No. PCT/US2010/060739 dated Jul. 4, 2012, 6 pages.

Gavia et al., U.S. Appl. No. 13/101,840 entitled, Earth-Boring Tools and Methods of Forming Such Earth-Boring Tools and Methods of Forming Such Earth-Boring Tools filed May 5, 2011.

* cited by examiner

EARTH-BORING TOOLS HAVING DIFFERING CUTTING ELEMENTS ON A BLADE AND RELATED METHODS

CROSS-REFERENCE TO RELATED APPLICATIONS

This application claims the benefit of U.S. Provisional Patent Application Ser. No. 61/290,401, filed Dec. 28, 2009 and entitled "Drill Bits and Other Earth-Boring Tools having Differing Cutting Elements on a Common Blade, and Related Methods," the disclosure of which is incorporated herein by reference in its entirety.

This application is related to U.S. patent application Ser. No. 13/022,288 filed Feb. 7, 2011, pending, which claims priority to U.S. Provisional Application No. 61/301,946, filed Feb. 5, 2010, expired; U.S. patent application Ser. No. 13/101,840, filed May 5, 2011, pending, U.S. patent application Ser. No. 13/204,459, filed Aug. 5, 2011, pending, which claims priority to U.S. Provisional Application No. 61/371,554, filed Aug. 6, 2010, expired; and U.S. Provisional Patent Application No. 61/596,433, filed Feb. 8, 2012.

TECHNICAL FIELD

Embodiments of the present invention relate to earth-boring tools, such as earth-boring rotary drill bits, and, more particularly, to earth-boring tools having features for reducing the adhesion of formation cuttings thereto during the formation of a wellbore, and to methods of forming such earth-boring tools.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit such as, for example, an earth-boring rotary drill bit. Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed-cutters and rolling-cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of the formation. Often various tools and components, including the drill bit, may be coupled together at the distal end of the drill string at the bottom of the wellbore being drilled. This assembly of tools and components is referred to in the art as a "bottom-hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

It is known in the art to use what are referred to in the art as a "reamer" devices (also referred to in the art as "hole opening devices" or "hole openers") in conjunction with a drill bit as part of a bottom-hole assembly when drilling a wellbore in a subterranean formation. In such a configuration, the drill bit operates as a "pilot" bit to form a pilot bore in the subterranean formation. As the drill bit and bottom-hole assembly advances into the formation, the reamer device follows the drill bit through the pilot bore and enlarges the diameter of, or "reams," the pilot bore.

The bodies of earth-boring tools, such as drill bits and reamers, are often provided with fluid courses, such as "junk slots," to allow drilling mud (which may include drilling fluid and formation cuttings generated by the tools that are entrained within the fluid) to pass upwardly around the bodies of the tools into the annular shaped space within the wellbore above the tools outside the drill string.

When drilling a wellbore, the formation cuttings may adhere to, or "ball" on, the surface of the drill bit. The cuttings may accumulate on the cutting elements and the surfaces of the drill bit or other tool, and may collect in any void, gap or recess created between the various structural components of the bit. This phenomenon is particularly enhanced in formations that fail plastically, such as in certain shales, mudstones, siltstones, limestones and other relatively ductile formations. The cuttings from such formations may become mechanically packed in the aforementioned voids, gaps or recesses on the exterior of the drill bit. In other cases, such as when drilling certain shale formations, the adhesion between formation cuttings and a surface of a drill bit or other tool may be at least partially based on atomic attractive forces and/or bonds therebetween.

BRIEF SUMMARY

In some embodiments, the present invention includes earth-boring tools for use in forming wellbores in subterranean formations. The tools include a body, at least one blade projecting outwardly from the body, and a plurality of cutting elements carried by the at least one blade. The plurality of cutting elements includes at least one shearing cutting element, and at least one gouging cutting element located adjacent to the at least one shearing cutting element. The at least one shearing cutting element may have an at least substantially planar cutting face that is positioned and oriented for shearing a subterranean formation when the earth-boring tool is used to form a wellbore. The at least one gouging cutting element may have an at least substantially non-planar cutting face positioned and oriented for at least one of crushing and gouging a subterranean formation when the earth-boring tool is used to form a wellbore.

In additional embodiments, the plurality of cutting elements carried by the at least one blade of such earth-boring tools may include at least two shearing cutting elements, and at least one gouging cutting element located between two shearing cutting elements of the at least two shearing cutting elements.

In yet additional embodiments, the plurality of cutting elements carried by the at least one blade of such earth-boring tools may include at least two gouging cutting elements, and at least one shearing cutting element located between two gouging cutting elements of the at least two gouging cutting elements.

In yet further embodiments, the present invention includes methods of forming an earth-boring tool. A plurality of cutting elements may be attached to at least one blade on a body of an earth-boring tool. At least one of the plurality of cutting elements may be selected to include a shearing cutting element comprising an at least substantially planar cutting face. The shearing cutting element may be located and oriented on the blade for shearing a subterranean formation when the earth-boring tool is used to form a wellbore. At least one of the plurality of cutting elements may be selected to include a gouging cutting element comprising a non-planar cutting face. The gouging cutting element may be located and oriented for at least one of crushing and gouging a subterranean formation when the earth-boring tool is used to form a wellbore. The gouging cutting element may be located adjacent to the at least one shearing cutting element on the at least one blade.

In additional embodiments, at least two of the plurality of cutting elements may be selected to include shearing cutting elements, and at least one of the plurality of cutting elements may be selected to include a gouging cutting element. The gouging cutting element may be located between the at least two shearing cutting elements on the at least one blade.

In yet additional embodiments, at least two of the plurality of cutting elements may be selected to include gouging cutting elements, and at least one of the plurality of cutting elements may be selected to include a shearing cutting element. The shearing cutting element may be located between the at least two gouging cutting elements on the at least one blade.

In yet further embodiments, the present invention includes an earth-boring tool for use in forming or enlarging a wellbore, including a body having a centerline and a plurality of blades. Each blade of the plurality of blades may project outwardly from the body and carry a plurality of cutting elements. The plurality of cutting elements may include at least one shearing cutting element comprising an at least substantially planar cutting face. The at least one shearing cutting element may be positioned at a first radial distance from the centerline of the body on a first blade of the plurality of blades. The plurality of cutting elements may also include at least two gouging cutting elements each comprising an at least substantially non-planar cutting face. At least one gouging cutting element of the at least two gouging cutting elements may be positioned on the first blade of the plurality of blades and at least another gouging cutting element of the at least two gouging cutting elements may be positioned at a second radial distance from the centerline of the body that is greater than the first radial distance on a second blade of the plurality of blades.

In yet further embodiments, the present invention includes a method of forming an earth-boring tool including positioning at least one shearing cutting element of a plurality of shearing cutting elements each comprising an at least substantially planar cutting face on a first blade of a plurality of blades secured to a body of the earth-boring tool at a first radial distance from a centerline of the body. The method also includes positioning at least one gouging cutting element of a plurality of gouging cutting elements each comprising a non-planar cutting face adjacent to the at least one shearing cutting element of the plurality of shearing cutting elements on the at least one blade. The method further includes positioning at least another gouging cutting element of the plurality of gouging cutting elements on a second blade of the plurality of blades rotationally trailing the first blade of the plurality of blades at a second radial distance from the centerline of the body greater than the first radial distance.

BRIEF DESCRIPTION OF THE SEVERAL VIEWS OF THE DRAWINGS

While the specification concludes with claims particularly pointing out and distinctly claiming what are regarded as embodiments of the present invention, various features and advantages of this invention may be more readily ascertained from the following description of example embodiments of the invention provided with reference to the accompanying drawings, in which:

DETAILED DESCRIPTION

The illustrations presented herein are not actual views of any particular earth-boring tool, drill bit, or component of such a tool or bit, but are merely idealized representations which are employed to describe embodiments of the present invention. Additionally, elements common between figures may retain the same numerical designation for convenience and clarity.

As used herein, the term earth-boring tool means and includes any tool used to remove formation material and form a bore (e.g., a wellbore) through the formation by way of the removal of the formation material. Earth-boring tools include, for example, rotary drill bits (e.g., fixed-cutter or "drag" bits and roller cone or "rock" bits), hybrid bits including both fixed-cutters and roller elements, coring bits, percussion bits, bi-center bits, reamers (including expandable reamers and fixed-wing reamers), and other so-called "hole-opening" tools.

As used herein, the term "cutting element" means and includes any element of an earth-boring tool that is used to cut or otherwise disintegrate formation material when the earth-boring tool is used to form or enlarge a bore in the formation.

As used herein, the term "shearing cutting element" means and includes any cutting element of an earth-boring tool that has an at least substantially planar cutting face that is configured to be located and oriented on the earth-boring tool for cutting formation material at least primarily by a shearing mechanism when the earth-boring tool is used to form or enlarge a bore in the formation.

As used herein, the term "gouging cutting element" means and includes any cutting element of an earth-boring tool that has a non-planar cutting face that is configured to be located and oriented on the earth-boring tool for cutting formation material at least primarily by at least one of a gouging and a crushing mechanism when the earth-boring tool is used to form or enlarge a bore in the formation.

Figure 1:
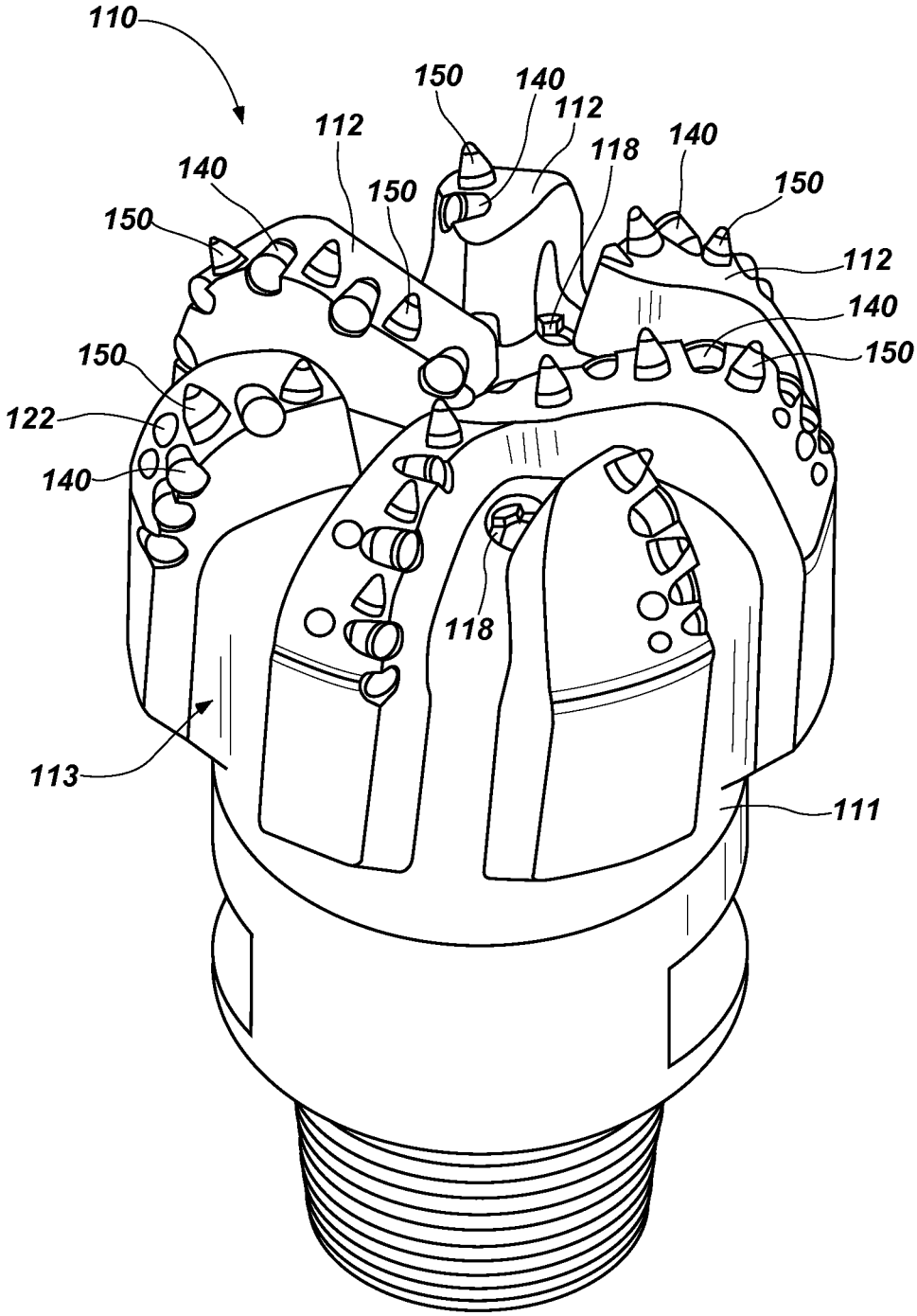
FIG. 1 is a perspective view of an embodiment of an earth-boring tool in accordance with an embodiment of the present invention that includes shearing cutting elements and gouging cutting elements on blades thereof.

FIG. 1 illustrates an embodiment of an earth-boring tool of the present invention. The earth-boring tool of FIG. 1 is a fixed-cutter drill bit 110 having a bit body 111 that includes a plurality of blades 112 that project outwardly from the bit body 111 and are separated from one another by fluid courses 113. The portions of the fluid courses 113 that extend along the radial sides (the "gage" areas of the drill bit 110) are often referred to in the art as "junk slots." The bit body 111 further includes a generally cylindrical internal fluid plenum, and fluid passageways that extend through the bit body 111 to the exterior surface of the bit body 111. Nozzles 118 may be secured within the fluid passageways proximate the exterior surface of the bit body 111 for controlling the hydraulics of the drill bit 110 during drilling. A plurality of cutting elements is mounted to each of the blades 112. The cutting elements include shearing cutting elements 140 and gouging cutting elements 150, as discussed in further detail below. Wear knots 122 also may be provided on the blades 112 rotationally behind the cutting elements, as shown in FIG. 1.

During a drilling operation, the drill bit 110 may be coupled to a drill string (not shown). As the drill bit 110 is rotated within the wellbore, drilling fluid may be pumped down the drill string, through the internal fluid plenum and fluid passageways within the bit body 111 of the drill bit 110, and out from the drill bit 110 through the nozzles 118. Formation cuttings generated by the cutting elements 140, 150 of the drill bit 110 may be carried with the drilling fluid through the fluid courses 113, around the drill bit 110, and back up the wellbore through the annular space within the wellbore outside the drill string.

Figure 2:
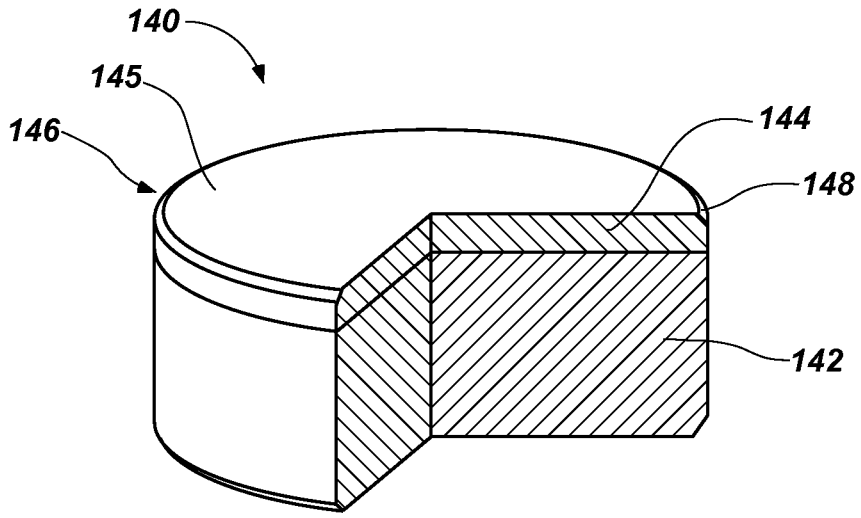
FIG. 2 is a partially cut-away perspective view of a shearing cutting element that may be used in embodiments of earth-boring tools of the present invention, like the earth-boring tool of FIG. 1.

FIG. 2 is a perspective view of a partially cut-away shearing cutting element 140 of the drill bit 110 of FIG. 1. The shearing cutting element 140 includes a cutting element substrate 142 having a diamond table 144 thereon. The diamond table 144 may comprise a polycrystalline diamond (PCD) material, and has an at least substantially planar cutting face 145. The diamond table 144 may be at least substantially planar (although the interface between the diamond table 144 and the substrate 142 may be non-planar, as known in the art). Optionally, the diamond table 144 may have a chamfered edge 146. The chamfered edge 146 of the diamond table 144 shown in FIG. 2 has a single chamfer surface 148, although the chamfered edge 146 also may have additional chamfer surfaces, and such chamfer surfaces may be oriented at chamfer angles that differ from the chamfer angle of the chamfer surface 148, as known in the art. The cutting element substrate 142 may have a generally cylindrical shape, as shown in FIG. 2.

The diamond table 144 may be formed on the cutting element substrate 142, or the diamond table 144 and the substrate 142 may be separately formed and subsequently attached together. The cutting element substrate 142 may be formed from a material that is relatively hard and resistant to wear. For example, the cutting element substrate 142 may be formed from and include ceramic-metal composite materials (which are often referred to as "cermet" materials). The cutting element substrate 142 may include a cemented carbide material, such as a cemented tungsten carbide material, in which tungsten carbide particles are cemented together in a metallic binder material. The metallic binder material may include, for example, cobalt, nickel, iron, or alloys and mixtures thereof.

As a shearing cutting element 140 cuts formation material, the formation cuttings generally are deflected over and across the substantially planar cutting face 145 of the shearing cutting element in a single direction generally away from (e.g., perpendicular to) the surface of the formation. The formation cuttings generated by a shearing cutting element generally are directed into a junk slot and not toward other adjacent cutting elements.

Figure 3:
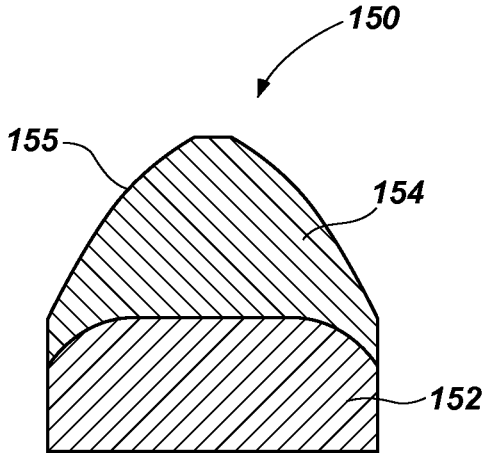
FIG. 3 illustrates a cross-sectional view of a dome-shaped gouging cutting element that may be used in embodiments of earth-boring tools of the present invention, like the earth-boring tool of FIG. 1.

FIG. 3 is a cross-sectional view of a gouging cutting element 150 of the drill bit 110 of FIG. 1. The gouging cutting element 150 may include a cutting element substrate 152 having a diamond table 154 thereon. The diamond table 154 may comprise a polycrystalline diamond (PCD) material, and may have a non-planar cutting face 155. The gouging cutting element 150 of FIG. 3 has a dome shape. In other words, the cutting face 155 of the diamond table 154 may have a dome shape. The cutting element substrate 152 may be generally similar to the cutting element substrate 142 of FIG. 2, and may be generally cylindrical and formed from the materials previously mentioned in relation to the cutting element substrate 142. Furthermore, the diamond table 154 may be formed on the cutting element substrate 152, or the diamond table 154 and the substrate 152 may be separately formed and subsequently attached together.

Figure 4:
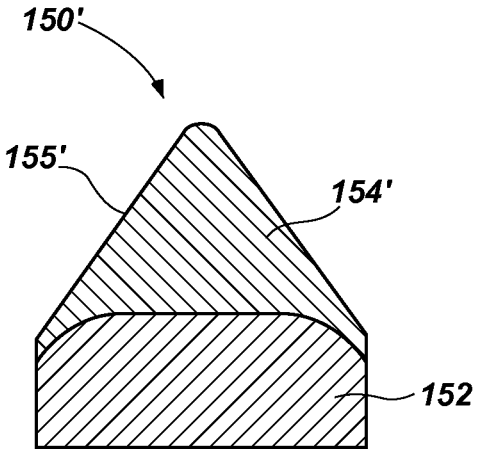
FIG. 4 illustrates a cross-sectional view of a cone-shaped gouging cutting element that may be used in embodiments of earth-boring tools of the present invention, like the earth-boring tool of FIG. 1.

FIG. 4 is a cross-sectional view of another gouging cutting element 150' that may be used on embodiments of earth-boring tools of the present invention, such as the drill bit 110 of FIG. 1. The gouging cutting element 150' is substantially similar to the gouging cutting element 150 of FIG. 3, but has a cone shape instead of a dome shape. In other words, a cutting face 155' of a diamond table 154' of the gouging cutting element 150' may have a conical shape.

Many different types of gouging cutting elements are known in the art and may be employed in embodiments of earth-boring tools of the present invention. For example, U.S. Pat. No. 5,890,552, issued Apr. 6, 1999 and entitled "Superabrasive-tipped Inserts for Earth-Boring Drill Bits," U.S. Pat. No. 6,332,503, issued Dec. 25, 2001 and entitled "Fixed Cutter Bit with Chisel or Vertical Cutting Elements," and U.S. Patent Application Publication No. US 2008/0035387 A1, published Feb. 14, 2008 and entitled "Downhole Drill Bit," the disclosures of each of which are incorporated herein in their entireties by this reference, disclose various configurations of gouging cutting elements that may be employed in embodiments of earth-boring tools of the present invention. Furthermore, gouging cutting elements having different shapes may be employed on the same earth-boring tool, and may be mounted on a common blade of an earth-boring tool, in accordance with further embodiments of the invention.

As a gouging cutting element 150, 150' cuts formation material, the formation cuttings generally are deflected over and around the non-planar cutting face 155, 155' of the gouging cutting element 150, 150' in several directions, including to the lateral sides of the gouging cutting element 150, 150' in directions generally parallel to the surface of the formation and toward adjacent cutting elements. Thus, formation cuttings generated by a gouging cutting element 150, 150' may be forced to pass between the gouging cutting element 150, 150' and an immediately adjacent cutting element. When the immediately adjacent cutting element is also a gouging cutting element 150, 150', formation cuttings generated by each of the immediately adjacent gouging cutting elements 150, 150' may be squeezed or extruded through the relatively small space between the immediately adjacent gouging cutting elements 150, 150'. Applicants have found that this squeezing or extrusion phenomenon may contribute to balling of formation material around the immediately adjacent gouging cutting elements 150, 150' in relatively softer formations. Embodiments of the present invention may reduce or eliminate this phenomenon by combining one or more gouging cutting elements 150, 150' with one or more shearing cutting elements 140 in a common row on a common blade of an earth-boring tool, such as the drill bit 110 of FIG. 1, as discussed in further detail below.

Referring again to FIG. 1, a plurality of cutting elements is mounted to each of the blades 112. Each of the primary blades 112 (i.e., the blades 112 that extend over the face of the bit body 111 to proximate the center of the drill bit 110) may include at least one shearing cutting element 140 and at least one gouging cutting element 150. In some embodiments, like that shown in FIG. 1, each of the secondary blades 112 (i.e., the blades 112 that do not extend to proximate the center of the drill bit 110) may also include at least one shearing cutting element 140 and at least one gouging cutting element 150. Thus, each blade 112 may include at least one shearing cutting element 140 and at least one gouging cutting element 150 in some embodiments of the invention.

The cutting elements 140, 150 mounted to each blade 112 may extend along the blade 112 in a row. At least one gouging cutting element 150 may be located directly between two shearing cutting elements 140 in one or more of the rows of cutting elements on the blades 112 of the drill bit 110. In other words, a first shearing cutting element 140 may be located directly adjacent a gouging cutting element 150 in a row of cutting elements on a blade 112 of the drill bit 110, and another shearing cutting element 140 may be located directly adjacent that same gouging cutting element 150 on a side thereof opposite the first shearing cutting element 140 on the same blade 112 of the drill bit 110. Similarly, at least one shearing cutting element 140 may be located directly between two gouging cutting elements 150 in one or more of the rows of cutting elements on the blades 112 of the drill bit 110. In other words, a first gouging cutting element 150 may be located directly adjacent a shearing cutting element 140 in a row of cutting elements on a blade 112 of the drill bit 110, and another gouging cutting element 150 may be located directly adjacent that same shearing cutting element 140 on a side thereof opposite the first gouging cutting element 150 on the same blade 112 of the drill bit 110.

In some embodiments, each row of cutting elements on each of the blades 112 may include alternating shearing cutting elements 140 and gouging cutting elements 150, such that at least two shearing cutting elements 140 are each disposed directly between two respective gouging cutting elements 150, and such that at least two gouging cutting elements 150 are disposed directly between two respective shearing cutting elements 140 on each blade 112.

The shearing cutting elements 140 optionally may be mounted with a positive back rake angle or a negative back rake angle (i.e., a forward rake angle). The shearing cutting elements 140 also may be mounted with a side rake angle. Similarly, the gouging cutting elements 150 also may be mounted with a back rake angle, with a side rake angle, or with both a back rake angle and a side rake angle. As a non-limiting example, the gouging cutting elements 150 may be mounted with a back rake angle of approximately ninety degrees (90°), such that the longitudinal axis of the gouging cutting elements 150 extends generally perpendicular to the surrounding outer formation-engaging surface of the blade 112. In other words, the gouging cutting elements 150 may point outwardly from the blade 112 in a direction generally perpendicular thereto in some embodiments of the invention. In other embodiments, the gouging cutting elements 150 may have a lower back rake angle (e.g., forty-five degrees (45°)) and may point in a rotationally forward direction, as illustrated in FIG. 1.

Although not shown in FIG. 1, one or more of the blades 112 of the drill bit 110 may also include one or more rows of backup cutting elements. Such backup cutting elements may be mounted to the blades 112 rotationally behind the primary cutting elements 140, 150 of the blades 112. Such backup cutting elements may be redundant with primary cutting elements 140, 150. In other words, a backup cutting element may be located at the same longitudinal and radial position in the cutting element profile as a primary cutting element 140, 150, such that the backup cutting element will at least substantially follow the cutting path of the corresponding primary cutting element 140, 150.

Figure 5:
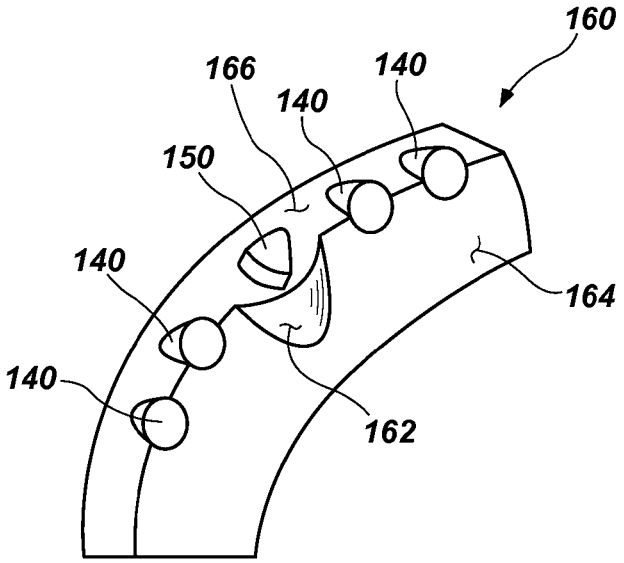
FIG. 5 is a simplified illustration of a perspective view of a blade, which may be incorporated in embodiments of earth-boring tools of the present invention, and that includes a blade protrusion proximate a gouging cutting element disposed between two shearing cutting elements.

FIG. 5 is a simplified illustration of a perspective view of another blade 160, which may be incorporated in embodiments of earth-boring tools of the present invention, such as the rotary drill bit 110 of FIG. 1. The blade 160 includes a blade protrusion 162 proximate a gouging cutting element 150 that is disposed between two shearing cutting elements 140. The blade protrusion 162 may project rotationally forward from a rotationally leading surface 164 of the blade 160 proximate the gouging cutting element 150. The blade protrusion 162 may be aligned with the gouging cutting element 150, such that the gouging cutting element 150 is directly rotationally behind the blade protrusion 162 as an earth-boring tool carrying the blade 160 is rotated within a wellbore. In additional embodiments, the blade 160 may include additional complementary gouging cutting elements 150 and blade protrusions 162. In some embodiments, the gouging cutting element 150 may be at least partially supported by at least a portion of the blade protrusion 162. In such embodiments, the gouging cutting element 150 may be positioned to rotationally lead at least the adjacent two shearing cutting elements 140 in the row of cutting elements 140, 150 carried by the blade 160 when an earth-boring tool carrying the blade 160 is rotated within a wellbore. In other words, the gouging cutting element 150 may be located both between and rotationally in front of the immediately adjacent shearing cutting elements 140 on the blade 160. When the gouging cutting element 150 is positioned to rotationally lead at least the adjacent two shearing cutting elements 140 in the row of cutting elements 140, 150 carried by the blade 160, formation cuttings generated by the gouging cutting element 150 may be laterally deflected into the path of adjacent shearing cutting elements 140, which may then deflect those formation cuttings outwardly away from the surface of the blade 160 and into fluid courses.

In order to position the gouging cutting element 150 at the rotationally leading edge of the blade 160 beside or rotationally in front of adjacent shearing cutting elements 140, the protrusion 162 may be used to provide more body material for supporting the gouging cutting element 150.

In this configuration, the blade 160 may be relatively less susceptible to balling of formation material around the blade 160 when the blade 160 is used in forming a wellbore in at least some formations, when compared to previously known blades having cutting elements thereon. In particular, the blade protrusion 162 and relative positioning of the gouging cutting element 150 and the shearing cutting elements 140 may improve the ability of drilling fluid and formation cuttings carried therein to flow over the formation-engaging surface 166 of the blade 160, past the gouging cutting element 150, and into fluid courses and junk slots without getting trapped around the gouging cutting elements 150 on the formation-engaging surface 166 of the blade 160. It is noted that, in some embodiments, it may desirable to account for the blade protrusion 162 projecting rotationally forward from the rotationally leading surface 164 of the blade 160 (e.g., flow constriction caused by the blade protrusion 162) in the hydraulic design of the drill bit.

Figure 6:
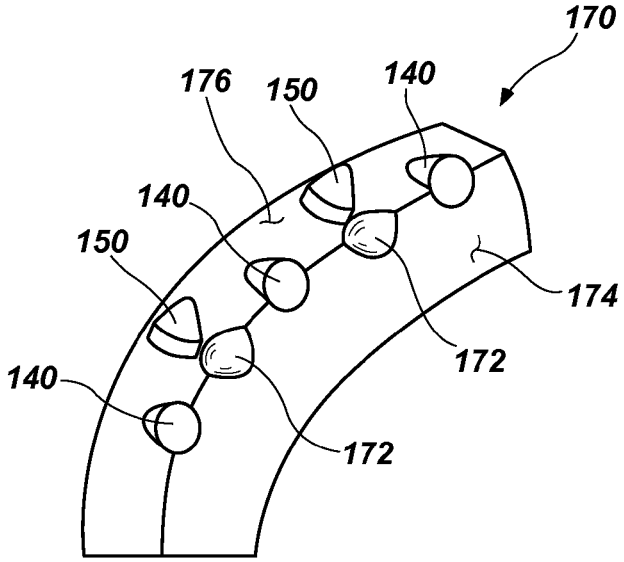
FIG. 6 is a simplified illustration of a perspective view of a blade, which may be incorporated in embodiments of earth-boring tools of the present invention, and that includes a blade recess proximate a gouging cutting element disposed between two shearing cutting elements.

FIG. 6 is a simplified illustration of a perspective view of another blade 170, which may be incorporated in embodiments of earth-boring tools of the present invention, such as the rotary drill bit 110 of FIG. 1. The blade 170 includes a blade recess 172 located proximate each of two gouging cutting elements 150. In additional embodiments, the blade 170 may include only a single blade recess 172 and corresponding gouging cutting element 150, or the blade 170 may include more than two complementary sets of blade recesses 172 and corresponding gouging cutting elements 150. Each of the blade recesses 172 and corresponding gouging cutting elements 150 are disposed directly between two shearing cutting elements 140 in the embodiment of FIG. 6. The blade recess 172 may extend into, and intersect, each of the rotationally leading surface 174 of the blade 170 and an outer formation-engaging surface 176 of the blade 170, proximate the gouging cutting element 150. Each of the blade recesses 172 may be aligned with the corresponding gouging cutting element 150, such that the gouging cutting elements 150 are directly rotationally behind their corresponding blade recesses 172 as an earth-boring tool carrying the blade 170 is rotated within a wellbore. In some embodiments, the gouging cutting elements 150 may be positioned to rotationally follow at least the adjacent two shearing cutting elements 140 in the row of cutting elements 140, 150 carried by the blade 170 when an earth-boring tool carrying the blade 170 is rotated within a wellbore. In other words, the gouging cutting elements 150 may be located both between and rotationally behind the immediately adjacent shearing cutting elements 140 on the blade 170.

In this configuration, the blade 170 may be relatively less susceptible to balling of formation material around the blade 170 when the blade 170 is used in forming a wellbore in at least some formations, when compared to previously known blades having cutting elements thereon. In particular, the recesses 172 and the relative positioning of the gouging cutting elements 150 and the shearing cutting elements 140 may improve the ability of drilling fluid and formation cuttings carried therein to flow over the formation-engaging surface 176 of the blade 170, past the gouging cutting elements 150, and into fluid courses and junk slots without getting trapped around the gouging cutting elements 150 on the formation-engaging surface 176 of the blade 170.

In yet further embodiments of the invention, a blade of an earth-boring tool may be provided with both a blade protrusion 162 proximate a gouging cutting element 150 that is disposed between two shearing cutting elements 140, as shown in FIG. 5, as well as a blade recess 172 located proximate another gouging cutting element 150 that is disposed between two shearing cutting elements 140, as shown in FIG. 6. As a non-limiting example, a fixed-cutter drill bit may comprise a blade having a blade protrusion 162 proximate a gouging cutting element 150 that is disposed between two shearing cutting elements 140 in a nose or shoulder region of the profile of the drill bit, and that has a blade recess 172 located proximate another gouging cutting element 150 that is disposed between two shearing cutting elements 140 in a cone region of the profile of the drill bit.

Figure 7:
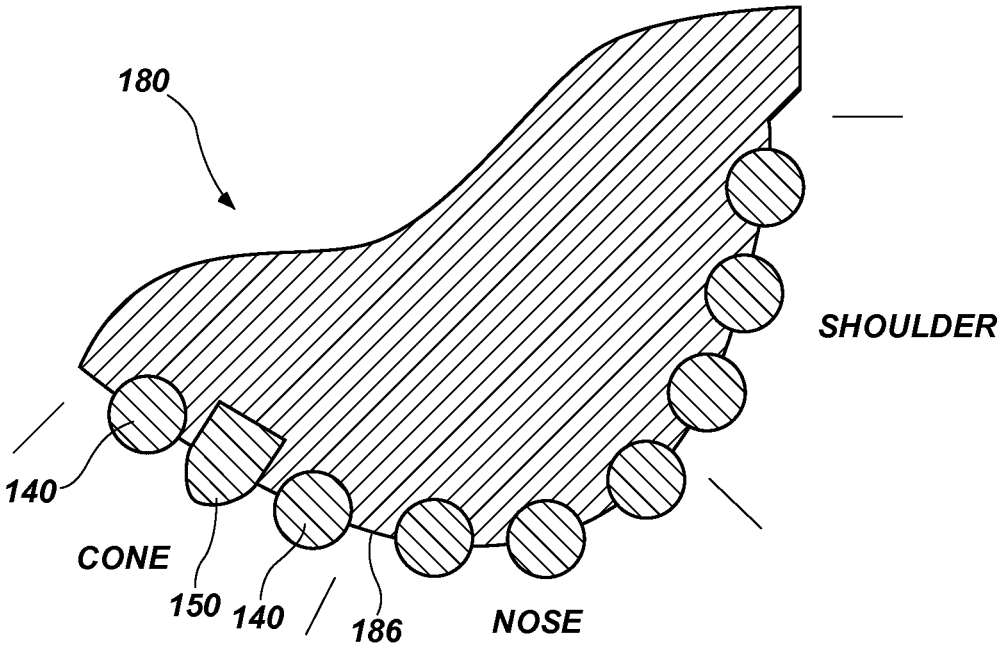
FIG. 7 is a simplified illustration of a cross-sectional view of a blade, which may be incorporated in embodiments of earth-boring tools of the present invention, and that includes a gouging cutting element disposed in a cone region of a profile of the blade between two shearing cutting elements.

FIG. 7 is a simplified illustration of a cross-sectional view of a blade 180, which may be incorporated in embodiments of drill bits of the present invention, such as the drill bit 110 of FIG. 1. As known in the art, an outer formation-engaging surface 186 of a blade 180 has a profile that includes a cone region, a nose region, and a shoulder region. As shown in FIG. 7, in some embodiments of the present invention, one or more gouging cutting elements 150 may only be disposed in the cone regions of the profile of a blade 180, and other regions (i.e., the nose and shoulder regions) of the profile of the blade 180 may include only shearing cutting elements 140. In some embodiments, one or more gouging cutting elements 150 may be positioned to have a profile equal to the profile of one or more adjacent shearing cutting elements 140. In other embodiments, one or more gouging cutting elements 150 may be positioned to have a profile greater than or less than the profile of one or more adjacent shearing cutting elements 140. Using gouging cutting elements 150 in the cone region of the profile of the blade 180 may reduce cutting aggressiveness without reducing efficiency in directional drilling applications, which may enhance the steerability of a drill bit carrying the blades 180. In other embodiments of the invention, however, gouging cutting elements 150 may be present in one or more of the cone region, the nose region, and the shoulder region of at least one blade (including all blades) of an earth-boring tool.

Figure 8:
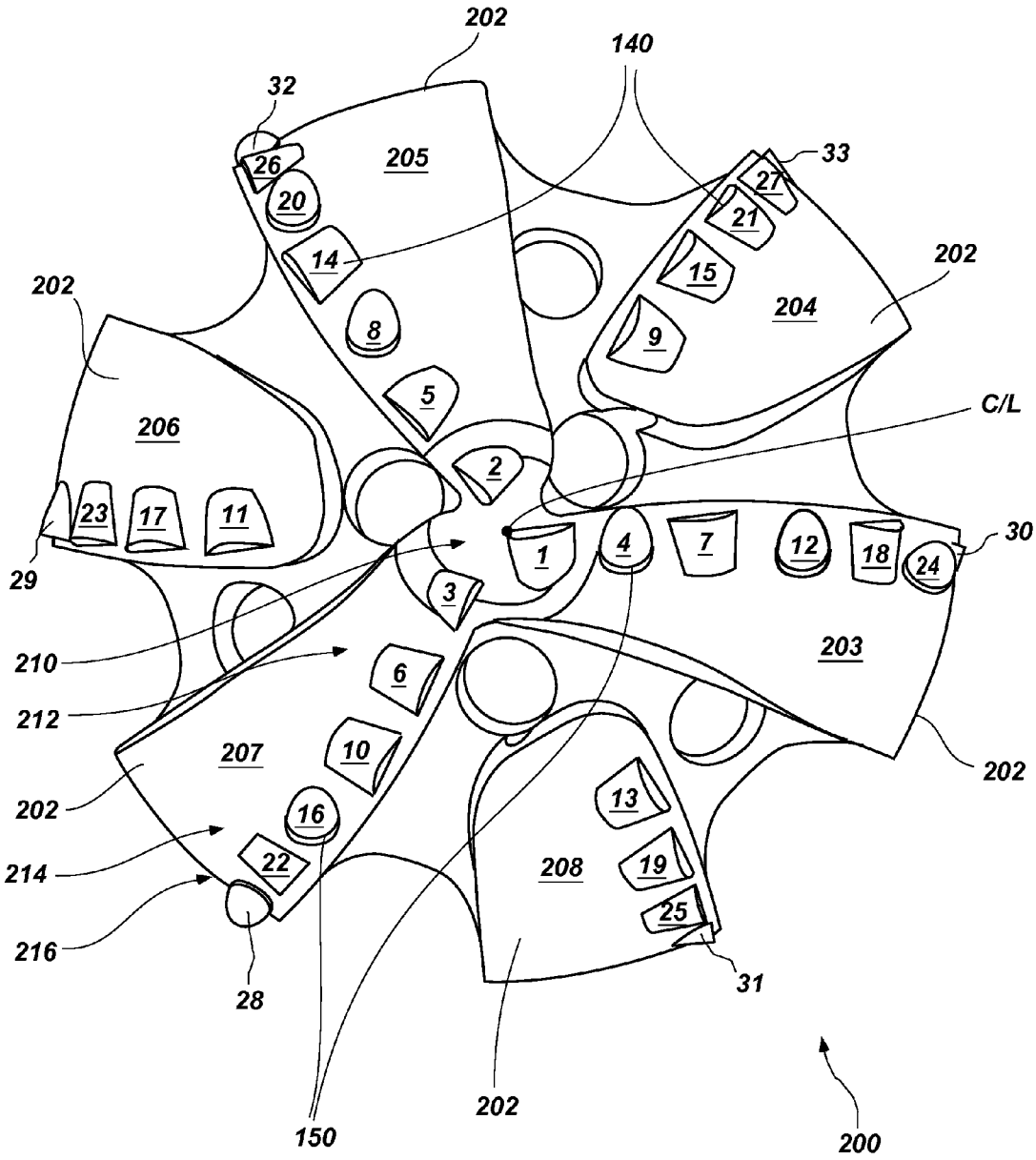
FIG. 8 is a partial top view of an earth-boring tool in accordance with another embodiment of the present invention that includes shearing cutting elements and gouging cutting elements on blades thereof laid out in a spiral configuration.

FIG. 8 is a partial top view of a drill bit 200 including shearing cutting elements 140 and gouging cutting elements 150 on blades 202 of the drill bit 200. As shown in FIG. 8, the drill bit 200 includes a cutter layout having varying cutting elements 140, 150 similar to those described above with reference to FIGS. 1 and 5 through 7. For example, a row of cutting elements 140, 150 on a blade 202 may be positioned to have a cutting element configuration of one or more gouging cutting elements 150 positioned adjacent to one or more shearing cutting elements 140. In some embodiments, a row of cutting elements 140, 150 on the blades 202 may include a cutting element configuration such as a gouging cutting element 150 positioned between two shearing cutting elements 140. In some embodiments, a row of cutting elements 140, 150 on the blades 202 may include a cutting element configuration such as a shearing cutting element 140 positioned between two gouging cutting element 150.

Cutter layouts providing one or more cutting element configurations having a variation of cutting elements 140, 150 on the blades 202 of the drill bit 200 may be designed using a cutter layout having a spiral configuration extending in a rotational direction around a centerline C/L of the drill bit 200. The spiral configuration may include one or more cutting element configurations that determine the cutter layout of the drill bit 200. As shown in FIG. 8, a spiral configuration may be designed by numbering each of the cutting elements 140, 150 relative to their radial placement on the blades 202 of the drill bit 200 relative to the centerline C/L of the drill bit 200. For example, as shown in FIG. 8, a cutting element (e.g., cutter 1) is positioned the least distance from the centerline C/L of the drill bit 200. In other words, the radial distance between the cutter 1 and the centerline C/L of the drill bit 200 is less than the remaining cutting elements (e.g., cutters 2 through 33). Cutter 2 is positioned the next least distance from the centerline C/L of the drill bit 200. In other words, the radial distance between the cutter 2 and the centerline C/L of the drill bit 200 is greater than the radial distance from the centerline C/L of cutter 1 but less than the remaining cutting elements (e.g., cutters 3 through 33). In a similar manner, each of the remaining cutting elements (e.g., cutters 3 through 33) may be positioned on blades 202 of the drill bit 200 where each incremental cutting element has a radial distance from the centerline C/L of the drill bit 200 that is greater than the radial distance of the previous cutting elements. As the cutters 1 through 33 are positioned around the blades 202 of the drill bit 200 at incrementally increasing radial distances from the centerline C/L of the drill bit 200, the cutters 1 through 33 form a spiral configuration about the centerline C/L of the drill bit 200.

In some embodiments, the spiral configuration may include a reverse spiral configuration that extends in the intended direction of drill bit 200 rotation (i.e., in a rotationally forward or leading direction). That is, each position of the cutters 1 through 33 is selected by moving to the next desired position of cutting element placement in the intended direction of drill bit 200 rotation. For example, cutter 1 may be positioned on blade 203. The next desired position of a cutting element (e.g., cutter 2) may be selected by moving to the next blade capable of supporting a cutting element in the next desired radial position (e.g., blade 205) in the intended direction of drill bit 200 rotation. In some embodiments, the next desired position of a cutting element may be a blade (e.g., blade 204) adjacent to blade 203 on which the cutter 1 was placed. In some embodiments, such as the drill bit 200 shown in FIG. 8 that includes both primary blades 203, 205, 207 and secondary blades 204, 206, 208, the next desired position of a cutting element in the cone region 210 of the drill bit 200 may be on a nonadjacent blade. For example, as shown in FIG. 8, cutter 2 is positioned on primary blade 205, which is not adjacent to cutter 1 positioned on primary blade 203. In other words, cutter 2 positioned on primary blade 205 is spaced from cutter 1 positioned on primary blade 203 in a direction of intended drill bit 200 rotation by blade 204. By way of further example, a cutting element (e.g., cutter 7) may be placed on blade 203 and the next cutter (e.g., cutter 8) may be positioned on a blade that is separated from the blade 203 by one or more blades, but less than a rotational distance of a blade (e.g., blade 206) opposing the blade 203. In other words, the cutter 8 may be positioned to be angularly offset from cutter 7 at an angular distance greater than three hundred and sixty degrees divided by n (360°/n) where n equal the number of blades on a drill bit, but less than one hundred and eighty degrees (180°). For example, as shown in FIG. 8, the drill bit 200 includes six (6) blades 202 (i.e., each blade 202 is offset from adjacent blades 202 at an angle of approximately sixty degrees (60°)). Cutter 8 on blade 203 may be positioned to be angularly offset from cutter 7 on blade 205 by an angular distance greater than 360°/6 (i.e., at an angle greater sixty degrees (60°)), but less than the angular distance between blade 203 and blade 206 that opposes blade 203 (i.e., at an angle less than one hundred and eighty degrees (180°)).

Referring still to FIG. 8, design of the spiral configuration for a cutter layout may depend on the number of blades 202 of the drill 200. For example, the drill bit 200 includes an even number of blades 202 (e.g., six (6) blades) formed thereon. Design of a desired cutter layout including variations of gouging cutting elements 150 and shearing cutting elements 140 carried by an even number of blades 202, may include one or more cutting element configurations forming the spiral configuration such as, for example, one gouging cutting element 150 to every three shearing cutting elements 140. In other words, the ratio of the number of shearing cutting elements 140 to the number of gouging cutting elements 150 is three to one (3:1). By way of further example and as shown in FIG. 8, cutters 1, 2, 3 are shearing cutting elements 140, cutter 4 is a gouging cutting element 150, cutters 5, 6, 7 are shearing cutting elements 140, cutter 8 is a gouging cutting element 150, and so on. In other embodiments, the ratio of shearing cutting elements 140 to gouging cutting elements 150 may be selected as any ratio (e.g., 1:1, 2:1, 1:2, 1:3, 3:2, 4:1, 4:2, 4:3, 5:1, etc.). In further embodiments, the ratio of shearing cutting elements 140 to gouging cutting elements 150 may be combinations of varying ratios (e.g., a first cutting element configuration having a 3:1 ratio and a second cutting element configuration having a 2:1 ratio). For example, cutters 1, 2, 3 may be shearing cutting elements 140, cutter 4 may be a gouging cutting element 150, cutters 5, 6 may be shearing cutting elements 140, cutter 7 may be a gouging cutting element 150, and so on. In yet further embodiments, the spiral configuration may be selected to provide a cutter layout having a variation of shearing cutting elements 140 and gouging cutting elements 150 in selected regions of the drill bit 200. For example, the spiral configuration may be designed to include a cutting element configuration having a variation of cutting elements 140, 150 in one or more of a cone region 210, a nose region 212, a shoulder region 214, a gage region 216, or combinations thereof.

Figure 9:
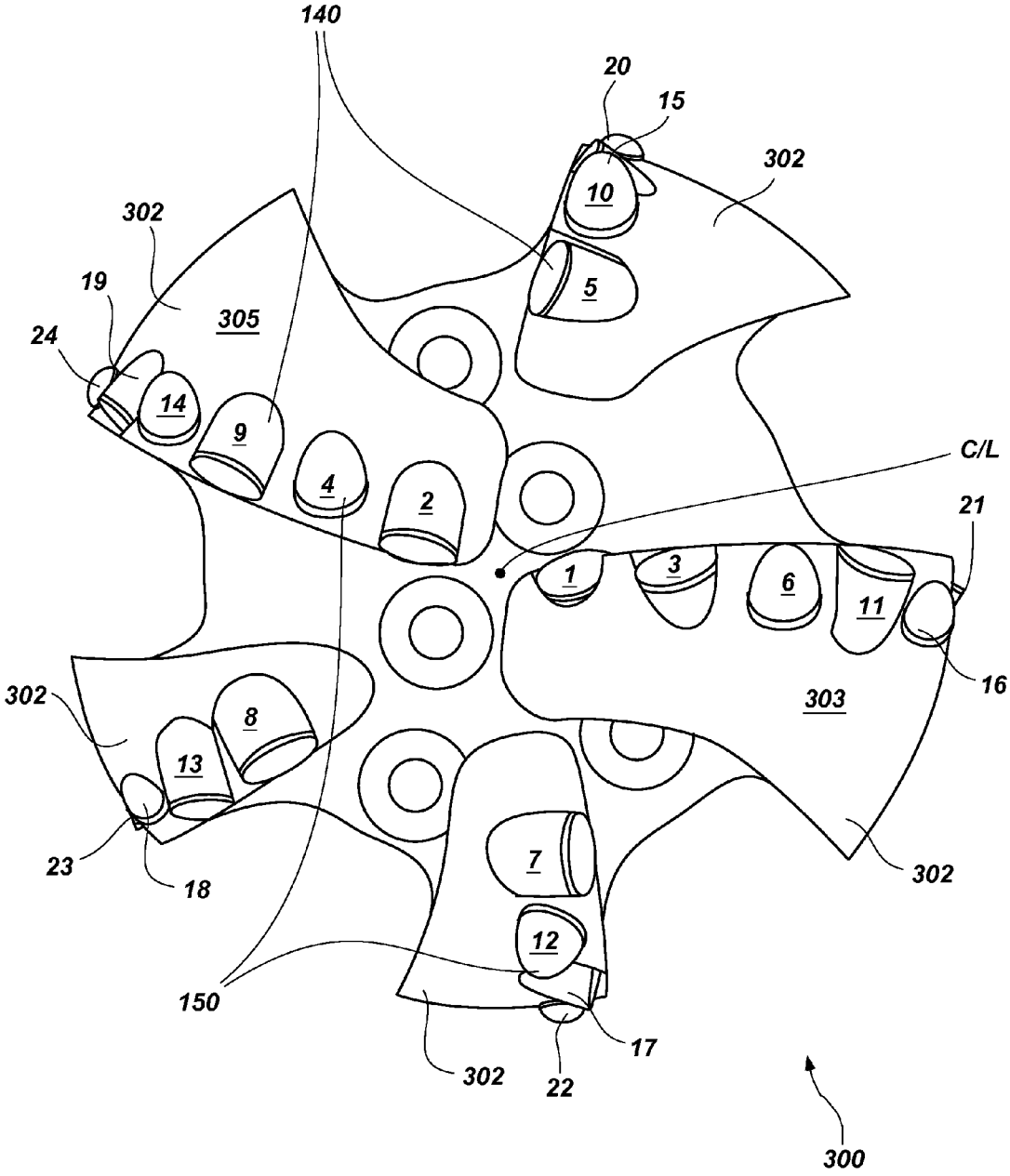
FIG. 9 is a partial top view of an earth-boring tool in accordance with yet another embodiment of the present invention that includes shearing cutting elements and gouging cutting elements on blades thereof laid out in a spiral configuration.

FIG. 9 is a partial top view of a drill bit 300 including shearing cutting elements 140 and gouging cutting elements 150 on blades 302 of the drill bit 300 laid out in a spiral configuration. As shown in FIG. 9, the drill bit 300 may include a spiral configuration having varying cutting elements 140, 150 similar to those described above with reference to FIGS. 1 and 5 through 8. For example, a row of cutting elements 140, 150 on a blade 302 may be positioned to have one or more gouging cutting elements 150 positioned adjacent to one or more shearing cutting elements 140. In some embodiments, the spiral configuration of the cutting elements 140, 150 may include a forward spiral configuration that extends opposite to the intended direction of drill bit 300 rotation (i.e., in a rotationally trailing or following direction). That is, each position of the cutters 1 through 24 is selected by moving to the next desired position of cutting element placement in a direction opposite to the intended direction of drill bit 300 rotation. For example, cutter 1 may be positioned on blade 303. The next desired position of a cutting element (e.g., cutter 2) may be selected by moving to the next blade capable of supporting a cutting element in the next desired radial position (e.g., blade 305) in a direction opposite to the intended direction of drill bit 300 rotation and so on.

As further shown in FIG. 9, the drill bit 300 may include an odd number of blades 302 (e.g., five (5) blades) formed thereon. Design of a desired cutter layout including variations of gouging cutting elements 150 and shearing cutting elements 140 carried by an odd number of blades 302, may include one or more cutting element configurations forming the spiral configuration such as, for example, one gouging cutting element 150 to one shearing cutting elements 140. In other words, the ratio of the number of shearing cutting elements 140 to the number of gouging cutting element 150 is one to one (1:1). In some embodiments, the initial cutters (e.g., cutters 1, 2 on the primary blades 303, 305) may include a cutting element configuration that differs from the remaining spiral configuration. For example, the initial cutters may be selected as shearing cutting elements 140 and a variation (e.g., a 1:1 ratio) of cutting elements 140, 150 may begin in the spiral configuration after the initial cutters. As shown in FIG. 9, cutters 1, 2 may be shearing cutting elements 140 and cutters 3, 5, 7, 9, 11, 13, 15, 17, 19, 21, 23 may be shearing cutting elements 140 and cutters 4, 6, 8, 10, 12, 14, 16, 18, 20, 22, 24 may be gouging cutting elements 150. Similar to the cutting element configurations described above with reference to FIG. 8, the ratio of shearing cutting elements 140 to gouging cutting elements 150 may be selected as any ratio (e.g., 1:1, 2:1, 1:2, 1:3, 3:2, 4:1, 4:2, 4:3, 5:1, etc.), combination of ratios (e.g., a first cutting element configuration having a 3:1 ratio and a second cutting element configuration having a 2:1 ratio), etc. It is noted that while the embodiments of FIGS. 8 and 9 describe and illustrate cutter layouts in a forward and reverse spiral configuration, in some embodiments, cutter layouts may include combinations of forward and reverse spiral configurations. For example, the shearing cutting elements may be laid out in a forward spiral configuration and the gouging cutting elements may be laid out in a reverse spiral configuration.

Earth-boring tools that include a mixture of both shearing cutting elements and gouging cutting elements on the same blade, as described hereinabove, may benefit from the different cutting actions of both the shearing cutting elements and the gouging cutting elements, while at the same time being less susceptible to balling in at least some types of formations as earth-boring tools that include only shearing cutting elements or only gouging cutting elements on each blade. In other words, varying gouging cutting elements and shearing cutting elements in a common row of cutting elements (e.g., a row of primary cutting elements or a row of backup cutting elements) on a common blade of an earth-boring tool, such as a fixed-cutter drill bit, may enhance the removal of formation cuttings across the blade, and provide a synergistic benefit of the combined crushing and shearing actions of the cutting elements that advantageously affects the performance of the bit.

The inclusion of gouging cutting elements may render fixed-cutter drill bits and other earth-boring tools employing polycrystalline diamond compact (PDC) shearing cutting elements more efficient in interbedded formations that include both soft, plastically behaving formations and hard formations. Furthermore, the inclusion of gouging cutting elements and shearing cutting elements on blades of fixed-cutter drill bits and other earth-boring tools may suppress undesirable torsional oscillations and, thus, render the drill bits and tools relatively more dynamically stable during drilling operations. Earth-boring tools that include a combination of gouging cutting elements and shearing cutting elements benefit from the ability of the gouging cutting elements to efficiently remove hard formation material through the crushing and gouging mechanism of the gouging cutting elements, as well as from the ability of the shearing cutting elements to efficiently remove relatively softer formation material through the shearing mechanism of the shearing cutting elements. Furthermore, earth-boring tools that include such combinations of cutting elements in common rows of cutting elements on common blades may benefit from a decreased susceptibility to balling in relatively softer formations, as previously discussed. Mixing gouging cutting elements and shearing cutting elements on the same blade may result in removal of a more balanced amount of damaged formation material per blade, relative to drill bits that include all shearing cutting elements on one or more blades and all gouging cutting elements on one or more other blades, and may reduce or eliminate the potential for packing of soft formation material between the cutting elements (e.g., balling around gouging cutting elements). Formation cuttings generated by a gouging cutting element that are deflected toward immediately adjacent shearing cutting elements may be deflected or scooped away from the surface of the formation and into fluid courses by the immediately adjacent shearing cutting elements.

Although the foregoing description contains many specifics, these are not to be construed as limiting the scope of the present invention, but merely as providing certain exemplary embodiments. Similarly, other embodiments of the invention may be devised which do not depart from the scope of the present invention. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

What is claimed is:

1. An earth-boring tool for use in forming or enlarging a wellbore, comprising:

a body;

at least one blade projecting outwardly from the body;

a plurality of cutting elements carried by the at least one blade, the plurality of cutting elements comprising:

at least two shearing cutting elements positioned proximate a rotationally leading surface of the at least one blade and each comprising an at least substantially planar cutting face positioned and oriented for shearing a subterranean formation when the earth-boring tool is rotated under applied force to form or enlarge a wellbore; and at least two gouging cutting elements positioned proximate the rotationally leading surface of the at least one blade, wherein at least one gouging cutting element of the at least two gouging cutting elements is located directly between two shearing cutting elements of the at least two shearing cutting elements, wherein at least one gouging cutting element of the at least two gouging cutting elements is positioned to rotationally lead the two shearing cutting elements of the at least two shearing cutting elements when the earth-boring tool is rotated under applied force to form or enlarge a wellbore, each of the at least two gouging cutting elements comprising an at least substantially non-planar cutting face positioned and oriented for at least one of crushing and gouging a subterranean formation when the earth-boring tool is rotated under applied force to form or enlarge a wellbore, wherein at least one shearing cutting element of the at least two shearing cutting elements is located between two gouging cutting elements of the at least two gouging cutting elements.

2. The earth-boring tool of claim 1, wherein the at least one blade comprises a blade protrusion projecting rotationally forward from the rotationally leading surface of the at least one blade proximate at least one gouging cutting element of the at least two gouging cutting elements, wherein the at least one gouging cutting element is at least partially supported by the blade protrusion.

3. The earth-boring tool of claim 1, wherein the at least one shearing cutting element of the at least two shearing cutting elements is located directly between the at least two gouging cutting elements.

4. The earth-boring tool of claim 1, wherein each of the at least two shearing cutting elements comprises a polycrystalline diamond material, and wherein the at least substantially planar cutting face of each of the at least two shearing cutting elements comprises a surface of the polycrystalline diamond material.

5. The earth-boring tool of claim 4, wherein at least one gouging cutting element of the at least two gouging cutting elements comprises a polycrystalline diamond material, and wherein the cutting face of the at least one gouging cutting element comprises a surface of the polycrystalline diamond material.

6. The earth-boring tool of claim 1, wherein the cutting face of at least one gouging cutting element of the at least two gouging cutting elements is at least one of dome-shaped and cone-shaped.

7. The earth-boring tool of claim 1, wherein the earth-boring tool comprises a fixed-cutter earth-boring rotary drill bit, and wherein at least one gouging cutting element of the at least two gouging cutting elements is located in a cone region of the fixed-cutter earth-boring rotary drill bit.

8. The earth-boring tool of claim 1, wherein the at least one blade comprises a plurality of blades, each blade of the plurality of blades projecting outwardly from the body and carrying a row of cutting elements, each row of cutting elements comprising alternating shearing cutting elements and gouging cutting elements, each shearing cutting element comprising a polycrystalline diamond material having an at least substantially planar cutting face positioned and oriented for shearing a subterranean formation when the earth-boring tool is rotated under applied force to form or enlarge a wellbore, each gouging cutting element comprising a polycrystalline diamond material having a substantially non-planar cutting face positioned and oriented for at least one of crushing and gouging a subterranean formation when the earth-boring tool is rotated under applied force to form or enlarge a wellbore.

9. The earth-boring tool of claim 1, wherein the at least one blade comprises a plurality of blades, each blade of the plurality of blades projecting outwardly from the body and wherein the at least one shearing cutting element is positioned at a first radial distance from a centerline of the body on a first blade of the plurality of blades and wherein at least another gouging cutting element is positioned at a second radial distance from the centerline of the body that is greater than the first radial distance on a second blade of the plurality of blades.

10. An earth-boring tool for use in forming or enlarging a wellbore, comprising:

a body;

at least one blade projecting outwardly from the body;

a plurality of cutting elements carried by the at least one blade, the plurality of cutting elements comprising:

at least two shearing cutting elements positioned proximate a rotationally leading surface of the at least one blade and comprising an at least substantially planar cutting face positioned and oriented for shearing a subterranean formation when the earth-boring tool is rotated under applied force to form or enlarge a wellbore; and at least one gouging cutting element positioned adjacent to the at least one shearing cutting element and proximate the rotationally leading surface of the at least one blade, the at least one gouging cutting element comprising an at least substantially non-planar cutting face positioned and oriented for at least one of crushing and gouging a subterranean formation when the earth-boring tool is rotated under applied force to form or enlarge a wellbore, wherein the at least one gouging cutting element is located between two shearing cutting elements of the at least two shearing cutting elements, wherein the at least one gouging cutting element is positioned to rotationally follow the two shearing cutting elements of the at least two shearing cutting elements when the earth-boring tool is rotated under applied force to form or enlarge a wellbore, and wherein the at least one blade comprises a recess extending into the rotationally leading surface and a radially outer face of the at least one blade proximate the at least one gouging cutting element.

11. A method of forming an earth-boring tool, comprising:

selecting at least two cutting elements to comprise two shearing cutting elements each comprising an at least substantially planar cutting face;

locating and orienting the two shearing cutting elements on at least one blade secured to a body of an earth-boring tool for shearing a subterranean formation when the earth-boring tool is used to form or enlarge a wellbore;

selecting at least one cutting element to comprise a gouging cutting element comprising a non-planar cutting face;

locating and orienting the gouging cutting element on the at least one blade for at least one of crushing and gouging a subterranean formation when the earth-boring tool is used to form or enlarge a wellbore; and locating the gouging cutting element adjacent to the two shearing cutting elements along a rotationally leading surface of the at least one blade; and positioning the gouging cutting element to rotationally lead the two shearing cutting elements when the earth-boring tool is used to form or enlarge a wellbore.

12. The method of claim 11, further comprising locating the gouging cutting element directly between the two shearing cutting elements on the at least one blade.

13. The method of claim 12, further comprising:

locating the two shearing cutting elements on at least one of a shoulder region and a gage region of the at least one blade; and locating the gouging cutting element on at least one of a shoulder region and a gage region of the at least one blade.

14. The method of claim 12, further comprising positioning the gouging cutting element to rotationally follow the two shearing cutting elements when the earth-boring tool is used to form or enlarge a wellbore.

15. The method of claim 11, wherein selecting at least one cutting element to comprise a gouging cutting element comprises selecting at least two cutting elements to comprise gouging cutting elements and wherein locating the gouging cutting element adjacent to the two shearing cutting elements on the at least one blade comprises locating one shearing cutting element of the two shearing cutting elements directly between the gouging cutting elements on the at least one blade.

16. The method of claim 11, wherein locating and orienting the two shearing cutting elements on at least one blade comprises locating or orienting at least one shearing cutting element of the two shearing cutting elements at a first radial distance from a centerline of the body on a first blade secured to the body of the earth-boring tool and further comprising locating and orienting at least another gouging cutting element at a second radial distance from the centerline of the body that is greater than the first radial distance on a second blade secured to the body of the earth-boring tool.

17. An earth-boring tool for use in forming or enlarging a wellbore, comprising:

a body having a centerline; and a plurality of blades, at least two blades of the plurality of blades projecting outwardly from the body and carrying a plurality of cutting elements positioned along a leading edge of each blade, the plurality of cutting elements comprising:

a plurality of shearing cutting elements, each shearing cutting element comprising an at least substantially planar cutting face, at least one shearing cutting element of the plurality of shearing cutting elements positioned at a first radial distance from the centerline of the body on a first blade of the plurality of blades; and at least two gouging cutting elements, each of the at least two gouging cutting elements comprising an at least substantially non-planar cutting face, at least one gouging cutting element of the at least two gouging cutting elements positioned on the first blade of the plurality of blades, at least another gouging cutting element of the at least two gouging cutting elements positioned at a second radial distance from the centerline of the body that is greater than the first radial distance on a second blade of the plurality of blades, wherein each of the at least one gouging cutting element and the at least another gouging cutting element is positioned between and rotationally leading two shearing cutting elements of the plurality of shearing cutting elements.

18. The earth-boring tool of claim 17, wherein the second blade of the plurality of blades rotationally trails the first blade of the plurality of blades in a direction of intended earth-boring tool rotation.

19. The earth-boring tool of claim 18, wherein the second blade of the plurality of blades is spaced from the first blade of the plurality of blades in the direction of intended earth-boring tool rotation by at least one additional blade of the plurality of blades.

20. The earth-boring tool of claim 17, wherein the second blade of the plurality of blades rotationally leads the first blade of the plurality of blades in a direction of intended earth-boring tool rotation.

21. The earth-boring tool of claim 17, wherein the at least one gouging cutting element comprises a plurality of gouging cutting elements and wherein each shearing cutting element of the plurality of shearing cutting elements is positioned at a first radial distance from the centerline of the body on a blade of the plurality of blades rotationally leading at least one gouging cutting element of the plurality of gouging cutting elements positioned at a second radial distance from the centerline of the body that is greater than the first radial distance on a second blade of the plurality of blades.

22. The earth-boring tool of claim 17, wherein the at least one gouging cutting element comprises a plurality of gouging cutting elements and wherein the plurality of shearing cutting elements and the plurality of gouging cutting elements are positioned on the plurality of blades in a spiral configuration extending in a rotational direction around the centerline of the body, the spiral configuration comprising a plurality of cutting element configurations, each cutting element configuration of the plurality of cutting element configurations comprising:

at least one shearing cutting element of the plurality of shearing cutting elements positioned on a first blade of the plurality of blades at a first radial distance from the centerline of the body; and at least one gouging cutting element of the plurality of gouging cutting elements positioned on a second blade of the plurality of blades rotationally trailing the first blade of the plurality of blades at a second radial distance from the centerline of the body greater than the first radial distance.

23. A method of forming an earth-boring tool, comprising:

positioning at least one shearing cutting element of a plurality of shearing cutting elements each comprising an at least substantially planar cutting face on at least one of a shoulder region and a gage region of a first blade of a plurality of blades secured to a body of the earth-boring tool at a first radial distance from a centerline of the body;

positioning at least one gouging cutting element of a plurality of gouging cutting elements each comprising a non-planar cutting face adjacent to the at least one shearing cutting element of the plurality of shearing cutting elements on at least one of a shoulder region and a gage region of the at least one blade at a rotationally leading surface of the at least one blade; and positioning at least another gouging cutting element of the plurality of gouging cutting elements on at least one of a shoulder region and a gage region of a second blade of the plurality of blades at a rotationally leading surface of the at least one blade and at a second radial distance from the centerline of the body greater than the first radial distance.

24. The method of forming an earth-boring tool of claim 23, further comprising repeating positioning at least one shearing cutting element of the plurality of shearing cutting elements on a first blade of the plurality of blades at a first radial distance from the centerline of the body and positioning at least one gouging cutting element of the plurality of gouging cutting elements on a second blade of the plurality of blades at a second radial distance from the centerline of the body greater than the first radial distance until at least one of a shearing cutting element of a plurality of shearing cutting elements and a gouging cutting element of plurality of gouging cutting elements is positioned proximate to a gage region of the plurality of blades.

* * * * *